United States Patent [19]

Dauchez

[11] Patent Number: 5,051,177

[45] Date of Patent: Sep. 24, 1991

[54] HIGH-INTENSITY MAGNETIC SEPARATOR

[75] Inventor: Gilbert Dauchez, Blanc-Mesnil, France

[73] Assignee: Fives-Cail Babcock, Montreuil, France

[21] Appl. No.: 513,908

[22] Filed: Apr. 24, 1990

[30] Foreign Application Priority Data

May 2, 1989 [FR] France ..... 89 05790

[51] Int. Cl.[5] ..... B03C 1/00

[52] U.S. Cl. ..... 210/222; 210/541; 210/542

[58] Field of Search ..... 210/222, 223, 541, 542, 210/695; 209/38-40, 212, 478, 213, 222; 204/155; 335/209, 225

[56] References Cited

U.S. PATENT DOCUMENTS 4,082,656 4/1978 Hedvall et al. ..... 210/222

*Primary Examiner*—Frank Sever

*Attorney, Agent, or Firm*—Collard, Roe & Galgano

[57] ABSTRACT

A high-intensity magnetic separator for separating paramagnetic particles from non-magnetic particles comprises a rotor including a shaft and a stack of alternating ring-shaped pole pieces and permanent magnets arranged on the shaft, the pole pieces and the permanent magnets having substantially equal diameters. To increase the service life of the rotor without noticeably reducing its performance, the permanent magnet is peripherally covered by a layer of ceramic material having a thickness of less than 50 μm.

5 Claims, 1 Drawing Sheet

HIGH-INTENSITY MAGNETIC SEPARATOR

Figure 1:
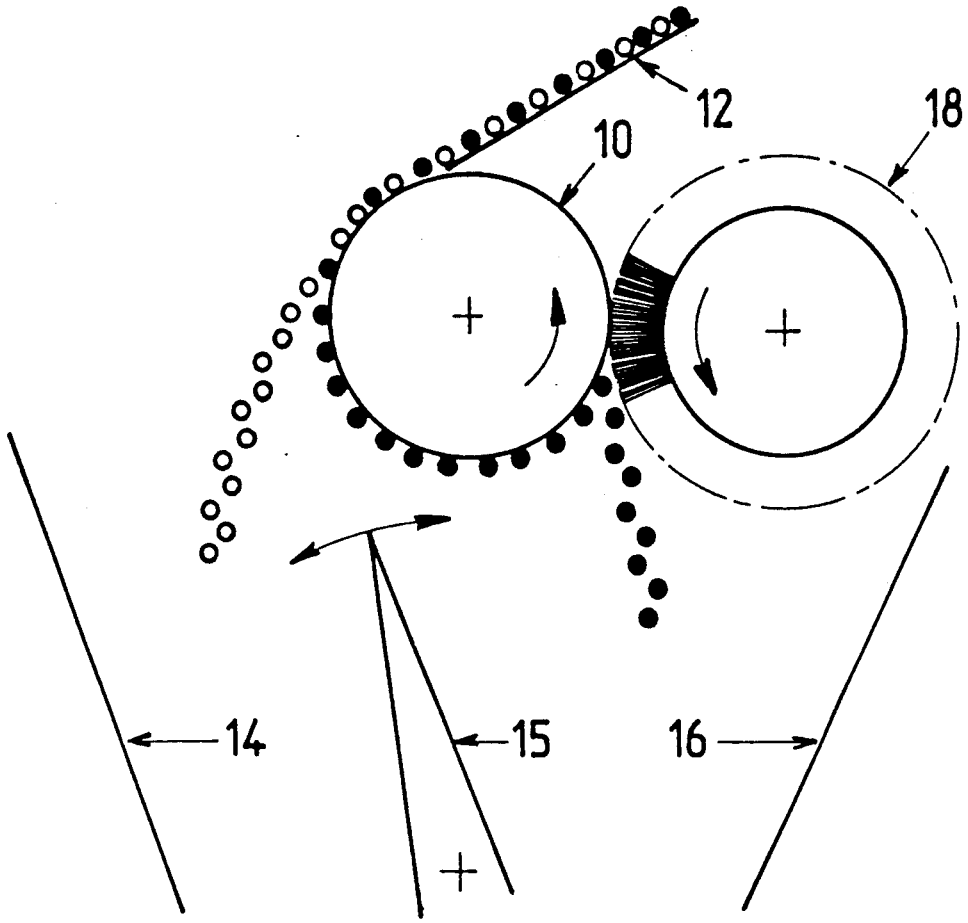

This invention relates to a high-intensity magnetic separator intended for the separation of low magnetic susceptibility products, and including a rotor consisting of a series of disk-shaped pole pieces coaxially arranged and separated from each other by ring-shaped axially-magnetized permanent magnets assembled so as to get alternately opposed magnetization directions, and consequently neighboring pole pieces with opposed polarities.

The invention relates more particularly to dry separation, though it can be profitable in certain wet process separation applications. As regards dry separation, the product to be processed, either in the form of powder or particles, is poured onto the rotor. Nonmagnetic particles are moved away from the rotor by centrifugal force and/or gravity forces, and fall into a collector placed below the rotor. Paramagnetic particles are attracted by the rotor, and carried by it beyond the place of fall of the nonmagnetic particles, and then removed by means of scrapers or brushes and collected in an independent tank. The separation can be completed by one or several adjustable flaps enabling to obtain products with different magnetic susceptibilities.

Certain products may subject the rotor to a significant corrosion and abrasion, particularly in the magnetic particle extraction zone where these particles are removed from the rotor by the scrapers or the brushes.

With a view to avoiding a quick deterioration of the magnets, which are expensive parts, it was suggested to protect their periphery by means of an anti-abrasion strip or lining made of rubber, epoxy resin or other plastic material. To ensure an efficient and durable protection, these linings must be relatively thick, in the order of one millimeter or more, and their presence is significantly detrimental to the performance of the rotor. It was suggested also to cover the magnets or the whole rotor with a stainless steel foil. But even using very thin foils, 0.1 mm thick for example, one notes a 20% or so decrease in the specific magnetic forces, and consequently in the performance of the rotor, as compared with a bare rotor.

The object of this invention is to remedy the drawbacks of the known solutions and to suggest improvements enabling the service life of the rotor to be extended without reducing noticeably its performance.

The object of the invention is accomplished with a rotor consisting of magnets peripherally lined with a less than 50 $\mu$m thick layer of a ceramic material, and of pole pieces the initial diameter of which is practically equal to that of the magnets.

Although very thin, the ceramic material lining ensures an efficient protection of the magnets against corrosion and abrasion. This lining is hot formed by projecting powder by means of a blowpipe or a plasma torch after the magnet is manufactured by pressing and sintering, but before it is magnetized.

The edge of the pole pieces could be lined as well, in the same way, with a layer of a ceramic material.

In conformity with another feature of the invention, the pole pieces are cut in mild steel laminated sheets generally used for the manufacture of peelable shims. This manufacturing process permits to produce very economically pole pieces the two sides of which are exactly parallel and which have a well specified thickness.

With a view to further reducing the wear, a rotary cylindrical brush rotating in the same direction as the rotor is preferably used to remove the paramagnetic particles from the rotor.

Figure 2:
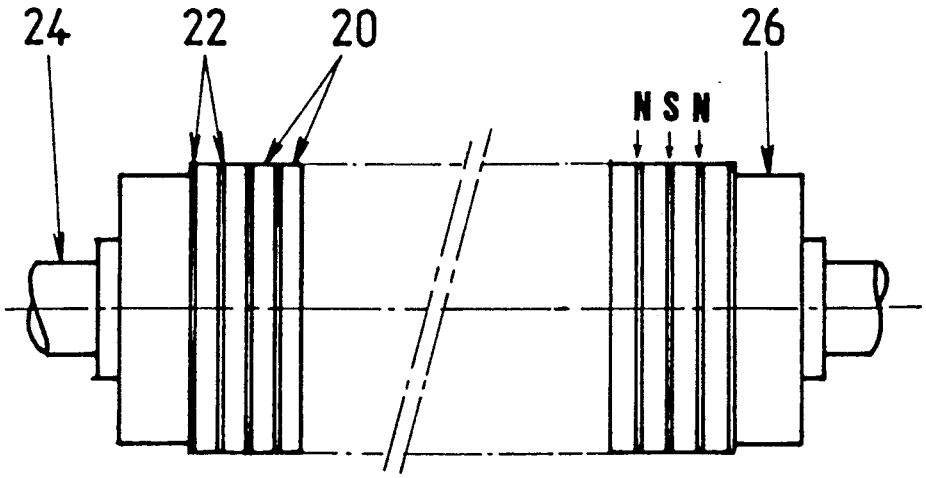

The following description refers to the accompanying drawing which shows, as a non-limiting example, an embodiment of the invention, and wherein FIG. 1 is a schematic cross-sectional view of a high-intensity magnetic separator in accordance with the invention and FIG. 2 is a vertical view of the rotor of the separator shown in FIG. 1.

The magnetic separator shown in FIG. 1 consists of a rotor 10, a feeding chute 12, two bins 14 and 16 which collect respectively the magnetic and paramagnetic particles, and which are separated by an adjustable flap 15, and a rotary brush 18 the axis of which is parallel to that of the rotor.

The cylindrically-shaped rotor has a horizontal axis and consists of a stacking of ring-shaped permanent magnets 20, e.g. samarium -cobalt or neodymium-iron-boron magnets, and of disk-shaped mild steel pole pieces 22, arranged alternately on a shaft 24 and pressed against each other by means of nuts 26. The magnets are axially magnetized and any two neighboring magnets have opposed directions of magnetization so that the neighboring pole pieces have opposed polarities.

The peripheral surface of the magnets is covered with a layer of a ceramic material formed by projecting powder, by means of a blowpipe or a plasma torch, or by other known techniques of making refractory coverings, during the manufacture of the magnets, after they are produced by pressing and sintering and before the magnetization. Titanium nitride or chromium carbide, for example, can be used for that purpose.

The pole pieces are produced by cutting laminated sheet of the type used for the manufacture of peelable shims.

The rotor is carried and driven into rotation by non-represented conventional means.

Brush 18 is placed practically on a level with the rotor, behind the latter and above bin 16. It is mounted on adjustable bearings to make it possible to adjust its position so that it comes into contact with the rotor without being pressed against the latter. Its diameter is of the same order of magnitude as that of the rotor, and its speed of rotation is practically equal to that of the rotor, the directions of rotation of both the rotor and the brush being identical.

As an example, in a 80 mm diameter rotor used to process products the particles of which were less than 1 mm (from 0.1 to 0.9 mm), the pole pieces were 0.75 mm thick and the magnets 4.25 mm thick. The brush had a diameter of 100 mm and its speed or rotation was equal to that of the rotor.

As a rule, the pitch—total thickness of a magnet plus pole piece assembly—depends on the grain size of the product to be processed, this pitch being all the greater as the particles are coarser, and the magnet thickness/-polee piece thickness ratio remains practically constant.

It must be understood that the invention is not limited to the embodiment described above, and that the modifications which can be made to it by substituting equivalent technical means come within the scope of the invention.

I claim:

1. A high-intensity magnetic separator for separating paramagnetic particles from non-magnetic particles, comprising (a) a rotor including (1) a shaft and (2) a stack of alternating ring-shaped pole pieces and permanent magnets arranged on the shaft, the pole pieces and the permanent magnets having substantially equal diameters, and the permanent magnets being peripherally covered by a layer of ceramic material having a thickness of less than 50 μm.

(b) means for removing the paramagnetic particles from the rotor, and (c) means for separately collecting the removed paramagnetic particles and the non-magnetic particles.

2. The high-intensity magnetic separator of claim 1, wherein the permanent magnets are pressed and sintered elements, and before the elements have been magnetized, the layers of ceramic material are hot formed on the peripheries of the elements by projecting a powder of the ceramic material thereon.

3. The high-intensity magnetic separator of claim 1, wherein the pole pieces are cut from mild steel laminated sheets.

4. The high-intensity magnetic separator of claim 1, wherein the means for removing the paramagnetic particles from the rotor comprises a rotary cylindrical brush having an axis extending parallel to the axis of the rotor and having a diameter substantially equal to that of the rotor.

5. The high-intensity magnetic separator of claim 4, wherein the brush is arranged substantially at the same level as the rotor and is in contact therewith, the brush being rotatable in the same direction as the rotor.

* * * * *